US006637507B2

(12) United States Patent
Cong

(10) Patent No.: US 6,637,507 B2
(45) Date of Patent: Oct. 28, 2003

(54) APPARATUS FOR CONTINUOUSLY PERFORATING IN OIL WELLS

(75) Inventor: Xueyi Cong, Daqing (CN)

(73) Assignee: Beijing Jinsuodao Investment and Consulting Co., Ltd., Beijing (CN)

( * ) Notice: Subject to any disclaimer, the term of this patent is extended or adjusted under 35 U.S.C. 154(b) by 50 days.

(21) Appl. No.: 10/002,561

(22) Filed: Nov. 15, 2001

(65) Prior Publication Data

US 2002/0060072 A1 May 23, 2002

(30) Foreign Application Priority Data

Nov. 20, 2000 (CN) ..... 00 1 32624 A

(51) Int. Cl.[7] ..... E21B 43/117
(52) U.S. Cl. ..... 166/55.1; 166/297
(58) Field of Search ..... 166/297, 55.1; 175/4.5; 102/317, 308

(56) References Cited

U.S. PATENT DOCUMENTS 2,986,214 A * 5/1961 Wiseman, Jr. et al. ..... 175/4.52
3,239,204 A * 3/1966 Brieger ..... 266/211
3,277,961 A * 10/1966 Bohn ..... 166/297
3,433,305 A * 3/1969 Bell ..... 166/297
4,193,460 A * 3/1980 Gilbert ..... 175/4.6
4,312,273 A * 1/1982 Camp ..... 102/310
4,598,775 A * 7/1986 Vann et al. ..... 175/4.6
5,054,564 A * 10/1991 Oestreich et al. ..... 175/4.6

* cited by examiner

*Primary Examiner*—Hoang Dang
(74) *Attorney, Agent, or Firm*—Mayer Fortkort & Williams, PC; Michael P. Fortkort, Esq.

(57) ABSTRACT

The invention relates to a process for continuously perforating in a wellbore comprising the following steps of determining a location to be perforated in the wellbore proximate an oil formation; placing an apparatus comprising a plurality of charges to said location in the wellbore; and continuously conducting perforation at said location with said charges in the apparatus. The invention also provides an apparatus for specifically performing the process, which comprises a transmitting system, a positioning system and a controlling system. The process and the apparatus can be used in a poor condition of the formation.

13 Claims, 2 Drawing Sheets

APPARATUS FOR CONTINUOUSLY PERFORATING IN OIL WELLS

FIELD OF THE INVENTION

The present invention relates to a process for perforating in oil wells, more particularly, to a process for continuously perforating at a predetermined place in a wellbore and an apparatus used for the same.

BACKGROUND OF THE INVENTION

Wellbores drilled through earth formations for extracting oil and gas are typically completed by coaxially inserting a steel pipe (a casing) into the wellbore. Perforations are made by detonating charges through the casing and a cement ring outside thereof into the formation to create channels, which allows oil and gas to enter the wellbore.

There have been various perforating devices in prior art such as a jet perforator, a bullet perforator, and a laser perforator. A test has shown a hole perforated on the ceramic by a perforator in the art can reach a maximum depth of 967.74 mm and a maximum diameter of 28.45 mm. It is obvious that the foregoing perforators are not ideal for those wellbores in a poor condition of the formation.

SUMMARY OF THE INVENTION

An object of the invention is to provide a process for perforating in a wellbore to overcome the shortcomings in prior art. The process according to the invention comprises the following steps of: determining a location to be perforated in the wellbore proximate an oil formation; placing an apparatus comprising a plurality of charges to the location in the wellbore; and continuously conducting perforation at the location with the charges in the apparatus.

Another object of the invention is to provide an apparatus for continuously perforating in a wellbore. The apparatus according to the present invention comprises i) transmitting system comprising a gun housing including a plurality of chambers arranged from top to bottom with an identical distance between each two adjacent chambers, each chamber comprising a charge; and a plurality of initiators positioned within the gun housing and connected to the charges, respectively; a plurality of first contacts positioned on the outer portion of the gun housing and connected to the initiators, respectively, ii) positioning system comprising a base; a fluid pressure fastener mounted under said base for fixing the positioning system to the wellbore; and a sliding rail connected to the base, on which the transmitting system moves up and down, and iii) controlling system comprising a string connected to the gun housing; a second contact positioned on the upper portion of the sliding rail and connected to a power; a first cable connected to the initiator for controlling the detonation of the charge; and a second cable connected to the fluid pressure fastener, wherein when the transmitting system moves down along the sliding rail, the first contacts contact the second contact consecutively to initiate the charges.

DETAILED DESCRIPTION OF THE INVENTION

Figure 1:
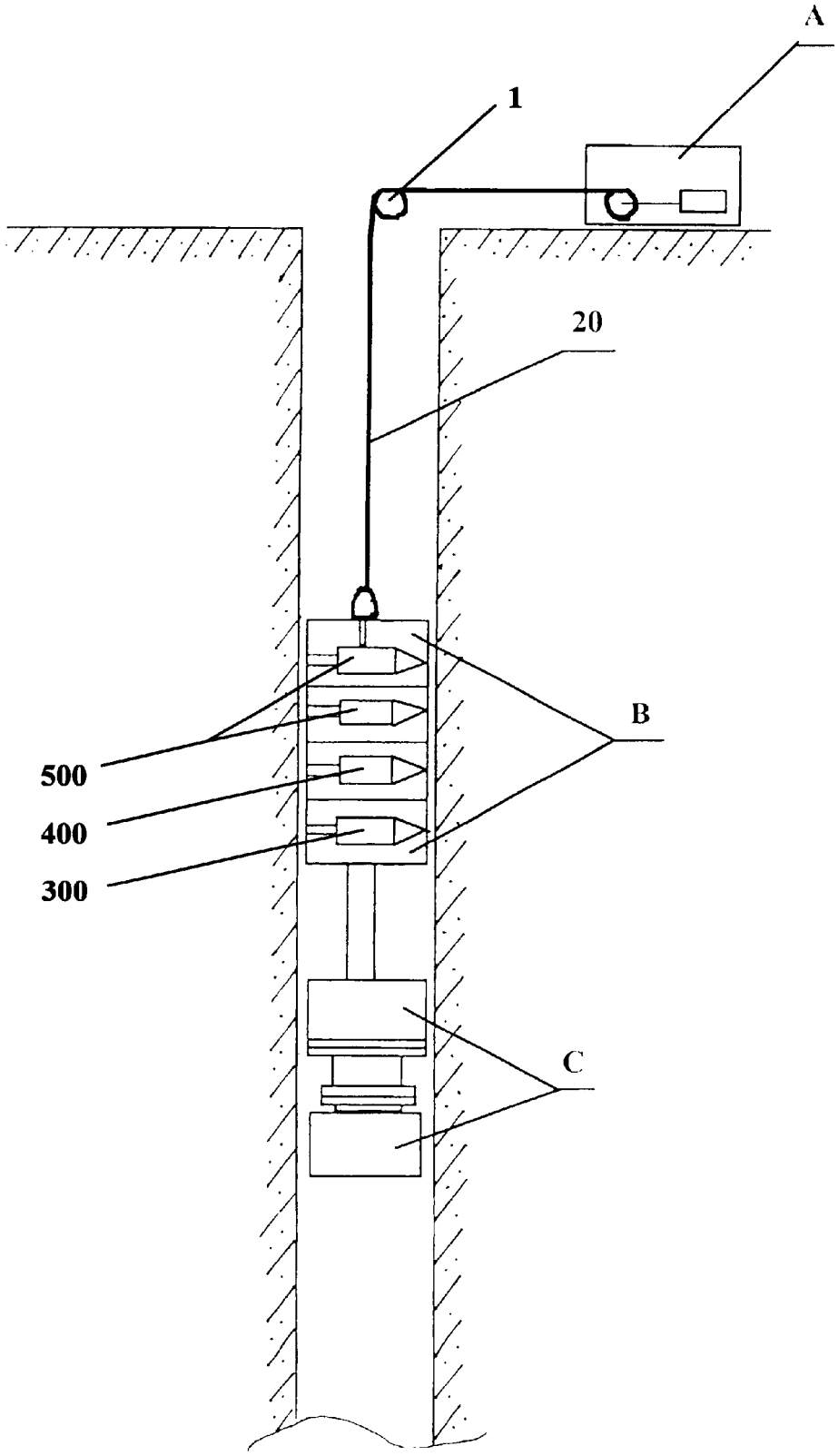
FIG. 1 schematically shows a view of one embodiment according to an apparatus of the invention.

The process according to the invention comprises the steps of a) determining a location to be perforated in the wellbore proximate an oil formation; b) placing an apparatus comprising a plurality of charges to said location in the wellbore; and c) continuously conducting perforation at said location with said charges in the apparatus.

The location in step a) is very obvious for those skilled in the art to determine by means of exploration before drilling the well.

Step b) may simultaneously be performed in different directions of the predetermined location, if necessary. That means, the process according to the invention may be used to perforate one ore more holes simultaneously in different directions in the wellbore. Step b) may comprise the following steps of: d) conducting perforation in the direction with a first charge; and f) conducting perforations in the direction with a second charge and a third charge.

In the invention, various charges used comprise the first charge, the second charge, and the third charge. The first charge is generally designed for breaking down a casing and a cement ring in the wellbore to form a hole with a diameter of around 15 mm and a depth of around 0.8 mm. The second charge is designed for enlarging the hole formed by the first charge. Then, the third charge may be used to further enlarge and deepen the hole formed by the second charge. These charges are to be selected for those skilled in the art such as explosive bullets, shaped charges and the like. For instance, the first charge may be selected from those perforating charges in the art, and the third charge may be a shaped charge.

In the invention, both the first charge and the second charge may be one but the third charge may be one or more. In general, the number of the third charge is 1–10, and 2–5 preferably.

As indicated above, the process of the invention may be used to perforate in different directions at the same time. In one embodiment, the process of the invention is performed in two opposite directions.

The apparatus according to the present invention generally comprises i) transmitting system comprising a gun housing including a plurality of chambers arranged from top to bottom with an identical distance between each two adjacent chambers, each chamber comprising a charge; a plurality of initiators positioned within the gun housing and connected to the charges, respectively; and a plurality of first contacts positioned on the outer portion of the gun housing and connected to the initiators, respectively; ii) positioning system comprising a base; a fluid pressure fastener mounted under the base for fixing the positioning system to the wellbore; and a sliding rail connected to the base, on which the transmitting system may move up and down, and iii) controlling system comprising a string connected to the gun housing; a second contact positioned on the upper portion of the sliding rail and connected to a power; a first cable connected to the initiator for controlling the detonation of the charge; and a second cable connected to the fluid pressure fastener. When the transmitting system moves down along the sliding rail, the first contacts contact the second contact consecutively to initiate the charges.

The chambers included in the gun housing of the transmitting system comprises a first chamber for housing a first charge, a second chamber for housing a second charge and a third chamber for housing a third charge from top to bottom, respectively. The distance between any two adjacent chambers is identical. The number of both the first charge and the second charge may be one, but the number of the third charge is one or more. The number of the third chambers may generally reach 1–10, preferably 2–5. The charges used in the invention may be those conventionally used in the art. The third charge in the invention preferably is a shaped charge. The number of the charges may also be adjusted in accordance with the requirements of the wellbore.

The fluid pressure fastener of the positioning system used in the invention may be those conventionally used in the art such as a hydraulically automatic fastener. The controlling system may further comprise a microcomputer for controlling the detonation of the transmitting system and the movement of the positioning system.

The apparatus according to the invention works as follows. First, the positioning system is sent to the predetermined location in the wellbore through the controlling system. The fluid pressure fastener is driven to fix the positioning system to the casing of the wellbore. Then, transmitting system moves down along the sliding rail by the controlling system. When the first contacts contact the second contact, the charges are initiated consecutively. When the last charge in the transmitting system is detonated, the transmitting system goes to the positioning system along the sliding rail, and contacts and effects the pressure relief rod by the weight itself.

The invention will be further described along with the accompanying drawings.

Referring now to FIG. 1, it schematically shows one embodiment of an apparatus according to the invention comprising a control system A arranged on the ground, a transmitting system B and a positioning system C in the wellbore controlled by the control system A. The transmitting system B comprises a first charge 300, a second charge 400 and five third charges 500 (only two third charges shown in FIG. 1)

Figure 2:
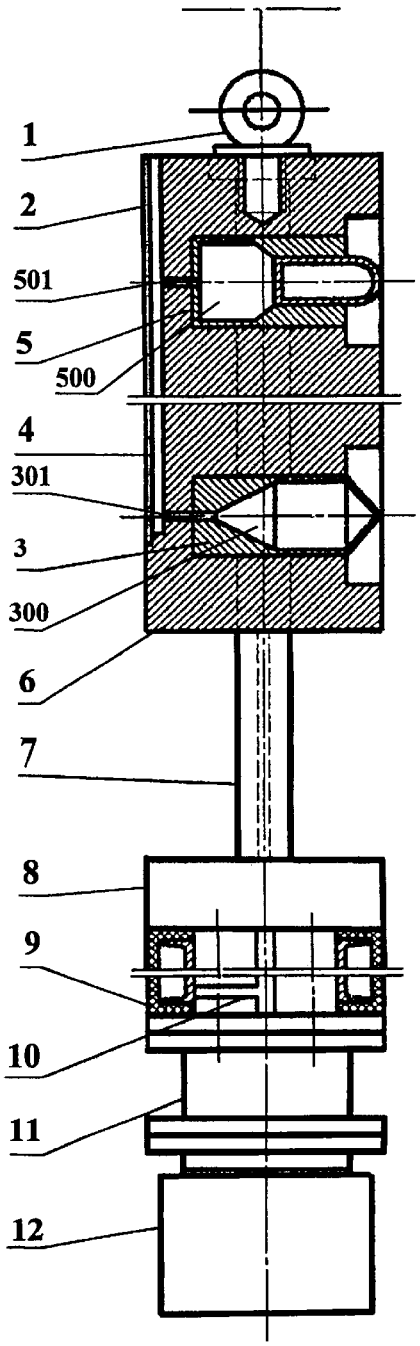
FIG. 2 schematically shows a partial view of the apparatus shown in FIG. 1.
Figure 3:
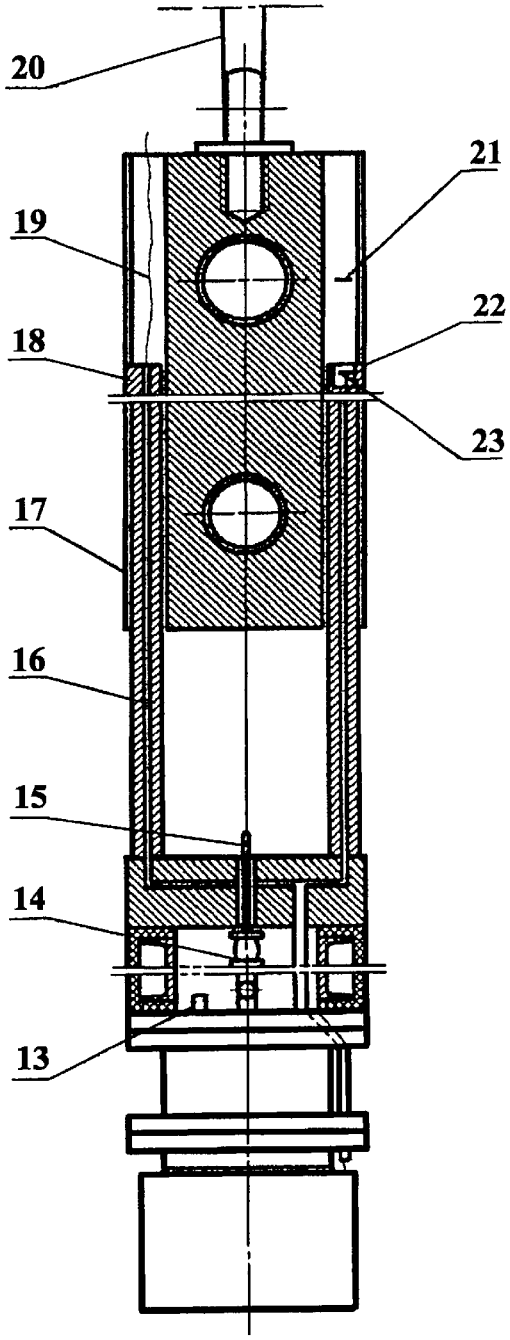
FIG. 3 shows a side cross-sectional view of FIG. 2.

FIGS. 2 and 3 schematically show a partial apparatus shown in FIG. 1. The transmitting system includes a gun housing 6 comprising a first chamber 3 and a third chamber 5, which respectively comprises a first charges 300 and a third charge 500 therein. Initiators 301 and 501 corresponding to the chambers 3 and 5 are disposed within the gun housing 6. A first cable 2 connected to the initiators 301 and 501 is arranged in a cable trough 4. A first contact 21 corresponding to the first chamber is disposed at the outer portion of the gun housing. A position-limiting plate 17 is positioned at the lowest portion out of the gun housing 6. A position-limiting lock 18 is connected to the upper portion of a sliding rail 7 which is mounted on a base 8 of the positioning system. A fluid fastener 9 is mounted to the base 8 and matched with a pressure relief valve 10, a pump 11 and a motor 12 for driving the pump 11. A pressure relief rod 15 is also mounted on the base 8. A second contact 23 disposed on a frame 22 positioned on the top of the sliding rail. A second cable 19 connected to the motor 12 is disposed in a cable channel 16.

In this embodiment, the distance between two adjacent chambers is identical, or 10 cm. FIGS. 2 and 3 show no second chamber. As stated above, however, in this embodiment, the number of the third chamber is 5 (partially shown in FIG. 1).

When the apparatus of the invention works, the controlling system A sends the positioning system to a predetermined position in the wellbore by a string 20 through a pulley 1. At this time, the position-limiting plate 17 is matched with the position-limiting lock 18 so that the transmitting system B moves down together with the positioning system C. When the positioning system C moves to the predetermined location, the controlling system drives the pump 12 via the cable 19 to provide a pressure to the fastener 9 so as to fix the positioning system C to the casing of the wellbore. In FIGS. 2 and 3, reference numeral 10 is a tube for exhausting oil and reference numeral 13 is an oil inlet. Then, the controlling system controls through the string 20 the transmitting system to slowly move downwards by its weight along the sliding rail 7. When the transmitting system goes half of the distance between two chambers, the first contact 21 meets the contact 23 at the upper portion of the sliding rail 7 to initiate the first initiator 301 to hereby detonate the first charge 300. The first charge 300 penetrates the casing and the cement ring of the well to form a hole in the formation with a diameter of about 15 mm and a depth of about 0.8 m. The transmitting system B continues to go downwards along the rail 7 at the same speed when the first charge 300 is detonated. As the second charge 400 moves to the position where the first charge 300 is transmitted, i.e. a whole distance between two chambers, the second first contact 21 meets the second contact 23 again to electrically detonate the second charge. The second charge penetrates the formation to form a channel with a diameter of 30 mm and a depth of 1.6 m based on the hole formed by the first charge. In the same way, the third charge can be transmitted at the same direction in the location. The third charge used in this embodiment is a shaped charge that releases a great deal of gas with high energy and may reach 2.5–3.0 m in the formation. A third charge can make an area with a diameter of 4 m in the formation ruptured. A channel with a diameter of 30 mm and a depth of 4 m is formed as all five third charges are detonated.

As the last third charge is transmitted, the transmitting system B moves to contact the pressure relief rod 15. The rod 15 effects the pressure relief valve 14 by its weight to render the fluid pressure fastener 9 pressure-released. The positioning system is hereby free of the casing of the wellbore. The transmitting system B and the positioning system A may be lifted out of the wellbore by the controlling system C through the string 20.

Although the invention has been described with the above description and embodiment, it is appreciated that the invention is not intended to limit thereto, and any modifications and variations to the invention without beyond the spirit of the invention should belong to the scope of the invention, which is defined by the appended claims.

What I claim is:

1. An apparatus used for continuously perforation a wellbore comprising:

i) transmitting system comprising:

a gun housing including a plurality of chambers arranged from top to bottom with an identical distance between each two adjacent chambers, each chamber comprising a charge; and a plurality of initiators positioned within said gun housing and connected to said charges, respectively;

a plurality of first contacts positioned on the outer portion of said gun housing and connected to said initiators, respectively;

ii) positioning system comprising:

a base;

a fluid pressure fastener mounted under said base for fixing the positioning system to the wellbore; and a sliding rail connected to said base, on which said transmitting system moves up and down, iii) controlling system comprising:

a string connected to said gun housing;

a second contact positioned on the upper portion of said sliding rail and connected to a power;

a first cable connected to said initiator for controlling the detonation of said charge; and a second cable connected to said fluid pressure fastener, wherein when said transmitting system moves down along said sliding rail, said first contacts contact said second contact consecutively to initiate said charges.

2. The apparatus according to claim 1, wherein said transmitting system further comprises a position-limiting plate positioned out of the lower portion of said gun housing, and said positioning system comprises a position-limiting lock connected to the upper portion of the sliding rail, wherein when said position-limiting lock is matched with the position-limiting plate, the positioning system is unable to separate the transmitting system.

3. The apparatus according to claim 1, wherein the positioning system further comprises an oil pump for providing a pressure to said fluid pressure fastener and a motor for driving said oil pump.

4. The apparatus according to claim 2, wherein the positioning system further comprises an oil pump for providing a pressure to said fluid pressure fastener and a motor for driving said oil pump.

5. The apparatus according to claim 1, wherein said chambers comprises a first chamber for housing a first charge, a second chamber for housing a second charge and a third chamber for housing a third charge from top to bottom, respectively.

6. The apparatus according to claim 5, wherein the number of both said first charge and said second charge is 1, and the number of said third charge is 2–5.

7. The apparatus according to claim 1, wherein said second cable is disposed within said sliding rail.

8. The apparatus according to claim 1, wherein said positioning system further comprising a pressure relief rod positioned on said base and a pressure relief valve connected between said pressure relief rod and said fluid pressure fastener so that when the transmitting system comes down to said pressure relief rod, said pressure rod releases the pressure of said fluid pressure fastener via said pressure relief valve.

9. The apparatus according to claim 2, wherein said positioning system further comprising a pressure relief rod positioned on said base and a pressure relief valve connected between said pressure relief rod and said fluid pressure fastener so that when the transmitting system comes down to said pressure relief rod, said pressure rod releases the pressure of said fluid pressure fastener via said pressure relief valve.

10. The apparatus according to claim 3, wherein said positioning system further comprising a pressure relief rod positioned on said base and a pressure relief valve connected between said pressure relief rod and said fluid pressure fastener so that when the transmitting system comes down to said pressure relief rod, said pressure rod releases the pressure of said fluid pressure fastener via said pressure relief valve.

11. The apparatus according to claim 5, wherein said positioning system further comprising a pressure relief rod positioned on said base and a pressure relief valve connected between said pressure relief rod and said fluid pressure fastener so that when the transmitting system comes down to said pressure relief rod, said pressure rod releases the pressure of said fluid pressure fastener via said pressure relief valve.

12. The apparatus according to claim 6, wherein said positioning system further comprising a pressure relief rod positioned on said base and a pressure relief valve connected between said pressure relief rod and said fluid pressure fastener so that when the transmitting system comes down to said pressure relief rod, said pressure rod releases the pressure of said fluid pressure fastener via said pressure relief valve.

13. The apparatus according to claim 7, wherein said positioning system further comprising a pressure relief rod positioned on said base and a pressure relief valve connected between said pressure relief rod and said fluid pressure fastener so that when the transmitting system comes down to said pressure relief rod, said pressure rod releases the pressure of said fluid pressure fastener via said pressure relief valve.

* * * * *